US007832497B2

(12) United States Patent
Wilson

(10) Patent No.: US 7,832,497 B2
(45) Date of Patent: Nov. 16, 2010

(54) SHOCK DAMPENING POST DRIVER

(76) Inventor: Robert Wilson, 425 Grandview, Lake Ozark, MO (US) 65049

( * ) Notice: Subject to any disclaimer, the term of this patent is extended or adjusted under 35 U.S.C. 154(b) by 131 days.

(21) Appl. No.: 12/163,654

(22) Filed: Jun. 27, 2008

(65) Prior Publication Data

US 2009/0090529 A1 Apr. 9, 2009

Related U.S. Application Data

(63) Continuation-in-part of application No. 11/867,669, filed on Oct. 4, 2007.

(51) Int. Cl.
*B25D 1/12* (2006.01)
*B25D 1/16* (2006.01)

(52) U.S. Cl. ..... 173/90; 173/91; 173/162.1

(58) Field of Classification Search ..... 173/90, 173/91, 102, 118, 162.1
See application file for complete search history.

(56) References Cited

U.S. PATENT DOCUMENTS

| | | | | |
|---|---|---|---|---|
| 299,086 | A | 5/1884 | Over | |
| 1,859,398 | A * | 5/1932 | Judd | 173/118 |
| 2,098,146 | A | 11/1937 | Hunt | |
| 2,998,087 | A | 8/1961 | Iddings | |
| 3,313,356 | A | 4/1967 | Clevenger | |
| 3,712,389 | A | 1/1973 | Smoak | |
| 3,747,690 | A * | 7/1973 | Deike | 173/118 |
| 4,494,612 | A | 1/1985 | Bell | |
| 4,971,479 | A | 11/1990 | Byers et al. | |
| 5,020,605 | A | 6/1991 | Leishman | |
| 5,029,651 | A | 7/1991 | Ubbink | |
| 5,042,591 | A | 8/1991 | Hull | |
| 5,097,912 | A | 3/1992 | Bowers | |
| 5,502,910 | A | 4/1996 | Lucchesi | |
| 5,806,608 | A | 9/1998 | DuBois | |
| 5,921,530 | A | 7/1999 | Joyce et al. | |
| 7,089,694 | B2 | 8/2006 | Allen | |

OTHER PUBLICATIONS

Gempler's, Inc., Dead-Blow Post Driver Item No. 69200, Catalog dated Mar. 21, 2003.
Hoover Fence Co., Hand Post Driver FT-P6, www.hooverfence.com, web page dated Mar. 21, 2003.
REM Driver, Sign-Post Driver, www.remdriver.com, web page dated Mar. 21, 2003.
Ken Cove, Farm Fence Post Driver, www.kencove.com, web page dated Nov. 13, 2002.
Behlen Manufacturing Co., Post Driver, www.behlencountry.com, web page dated Mar. 21, 2003.

* cited by examiner

*Primary Examiner*—Rinaldi I. Rada
*Assistant Examiner*—Nathaniel Chukwurah
(74) *Attorney, Agent, or Firm*—Husch Blackwell LLP

(57) ABSTRACT

A post driver having rotational handles and a dampening device adapted to isolate the hands and arms of the user from shock.

16 Claims, 7 Drawing Sheets

SHOCK DAMPENING POST DRIVER

This is a Continuation in Part Application of application Ser. No. 11/867,669, which was filed Oct. 4, 2007 for a Shock Dampening Post Driver. As such, this application hereby incorporates by reference the entire disclosure of its parent application Ser. No. 11/867,669, including the specification, drawings and abstract thereof.

BACKGROUND OF INVENTION

1. Field of Invention

The present invention relates to a post driver. More specifically, the present invention relates to a vibration dampening post driver with adjustable handles for driving posts into the ground more comfortably and with less risk of injury.

2. Background Art

Fences have been used to mark territorial boundaries, prevent trespassers from entering a property, and contain livestock. These fences require that hundreds or thousands of posts be driven into the ground at regular or evenly spaced intervals. Historically, fence builders used large hammers to drive posts, though this was backbreaking—and often dangerous—work.

There have been some advances in the post driving art area. Cylindrical post driving devices, such as that shown in Hunt, U.S. Pat. No. 2,098,146—including a post tube, which is open only at the bottom of the tube, and handles on both sides of the tube—were invented long ago. In use, these post driving devices were positioned with the open end of the tube over the post, grasped at the handles, and repeatedly driven down so that the closed top end of the tube impacted the top of the post, driving the post into the ground.

However, these traditional post driving devices caused a great deal of vibration and tended to be very jarring to the hands and wrist of the user. Users of these post driving devices often experienced pain in their arms and back and typically experienced discomfort in their hands after repeated use. Additionally, the handles of such post drivers are static, as their positions cannot be adjusted to afford customized comfort to each particular user.

More recent advances in the area included the use of springs located inside and at the top of the post tube, also known as a driver housing, to somewhat dampen the force of the blow received when the posts are driven into the ground, such as that shown in Iddings, U.S. Pat. No. 2,998,087, and Bowers, U.S. Pat. No. 5,097,912. However, these newer post driving devices with springs internal to the post tube are limited in that the size and number of springs utilized is limited, and thus the dampening ability is minimal. While better than traditional post driving devices that have little or no impact dampening abilities, even these newer post driving devices do not contain sufficient impact dampening capabilities for many people who need to drive a large number of posts. Also, the location of the dampening spring is not effective for dampening the forces transferred from the handles to the hands or wrist of the user.

Consequently, a need has long been felt for a post driving device with adjustable handles having better dampening abilities to better cushion the jarring impact of driving posts into the ground.

BRIEF SUMMARY OF THE INVENTION

One or more of the embodiments of the present invention provide for an impact dampening post driving device which includes a shaft having an interior cavity extending to a downward facing opining or openings at a distal end of said shaft. Brackets are physically mounted onto the outside of the shaft for attaching the handles to the shaft. The handles are attached to the bracket by a floating mount. The floating mount allows for a dampening device or spring to be positioned between the handle attach points, or mounting flanges, and the brackets. The floating mount may also allow the handle to rotate between a first and second position about an axis parallel to the longitudinal axis of the post driver shaft. For example, in one embodiment the floating mount includes a mounting flange of a handle and a rotation flange, both of which have oversized apertures, and the bracket has a similarly sized aperture where the mounting flange and the rotation flange are floatingly mounted to the bracket by threading an undersized bolt through the apertures and capturing the bolt with a nut larger than said apertures. A dampening device is then positioned within the floating region between the bracket and mounting flange. In this way, a dampening spring sits between each handle and the shaft, as opposed to the handles being mounted directly to the shaft. In one embodiment, the rotation flange has a leading edge with first and second ends. When the handle (and thus the rotation flange) is rotated to the first position, the first end of the leading edge of the rotation flange abuts the shaft of the post driver, preventing further rotation of the handle in that direction. Similarly, when the handle is rotated in the opposite direction to the second position, the second end of the leading edge of the rotation flange abuts the shaft of the post driver, preventing further rotation of the handle in that direction. In one embodiment, the rotation flange has an irregular quadrilateral shape which allows the handle to rotate between at least two positions about the longitudinal axis of the bolt.

The dampening device or dampening spring by definition can be any elastic device or shock absorbing device, such as for example, but not limited to a bushing made of elastomeric material or a coiled spring or any other elastic device that substantially regains its original shape after compression or extension. As discussed above, the floating mount may include a rotational flange having a shape, such as an irregular quadrilateral, which allows a handle to rotate between at least two positions.

A user can grasp the handles and: (1) position either or both of the handles in a position perpendicular to the longitudinal central axis of the shaft; (2) position either or both of the handles in a position which is X degrees offset from this perpendicular position; or (3) position either or both of the handles in any position therebetween. The handles may lock into place or may be free to rotate. A user can then lift the device over a post such that the post is aligned with the opening at the bottom of the shaft. The user can then force the shaft down over the post such that the post enters the interior cavity through the downward facing opening and strike the closed top end of the shaft. This creates vibration and shock in the shaft, but the dampening springs between the shaft and the handles greatly reduce the vibration and shock reaching the handles held by the user, thus reducing the force transferred to the hands, arms and wrist of the user.

BRIEF DESCRIPTION OF THE DRAWINGS

For a better understanding of the present invention, reference may be made to the accompanying drawings in which.

DETAILED DESCRIPTION OF THE INVENTION

Figure 1:
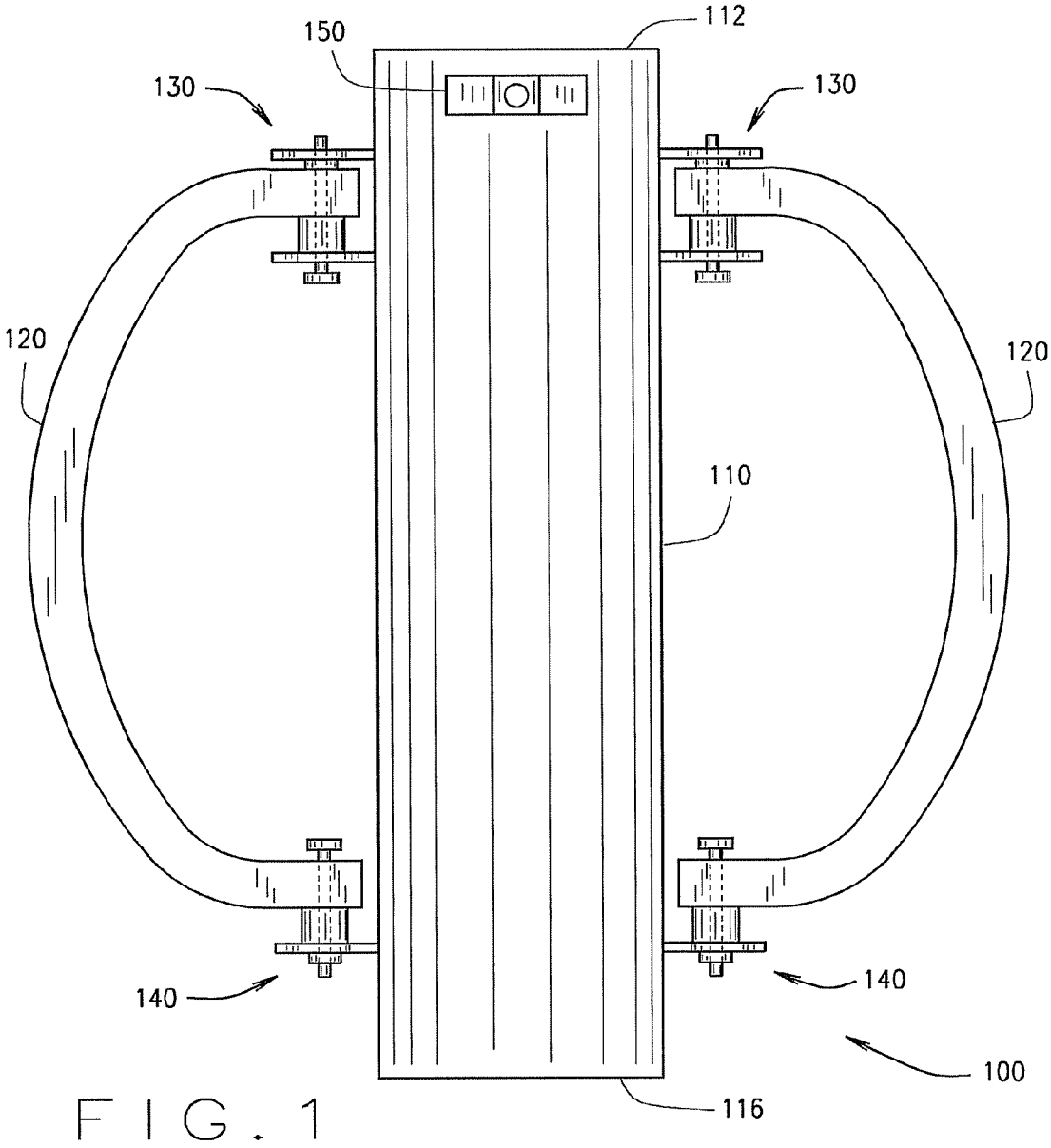
FIG. 1 is an elevation view of the post driving device.

A shock-dampening post driving device, according to an embodiment of the present invention, includes a shaft having an axially extending interior cavity that extends to a closed top end of the shaft and to a distal open bottom end of the shaft. The closed top end of the shaft forms a striking surface that is used to strike posts. The shaft also has a first mounting bracket extending from an exterior wall of the shaft. Additionally, an upper mounting flange of a handle is mounted to the first mounting bracket of the shaft by a first floating mount with a first floating region. The first floating mount may be adapted to allow the handle to rotate about an axis parallel to the longitudinal axis of the shaft between a first and second position. Further, a first dampening spring is positioned between the upper mounting joint of the handle and the first mounting bracket. This first dampening spring extends into the first floating region, where it dampens vibration between the shaft and the handle.

Another embodiment of a shock-dampening post driving device includes a handle mounted to a shaft by a first floating mount having a first floating region, where the first floating mount allows the handle to float or oscillate within said first floating region, and may also adapted to allow the handle to rotate about an axis parallel to the longitudinal axis of the shaft between a first and second position. Additionally, a first dampening spring is positioned between the handle and the shaft, where the first dampening spring extends into the first floating region, and where the first dampening spring dampens vibration between the shaft and the handle.

An embodiment of a shock-dampening post driving method includes striking an object with a closed top end of a shaft while said object is in an axially extending interior cavity of said shaft and dampening vibration between the shaft and a handle. The handle is floatingly attached to the shaft by a floating mount, which floating mount may be adapted to allow the handle to rotate about an axis parallel to the longitudinal axis of the shaft between a first and second position. The dampening occurs in a dampening spring positioned in a floating region of the floating mount between said handle and said shaft.

Another embodiment of a post driver device includes a shaft having an axially extending interior cavity which extends to a closed top end of the shaft and to an open bottom end of the shaft. The closed top end forms a striking surface. A first mounting bracket extends from the exterior wall of the shaft. A handle is rotatably mounted to the mounting bracket, and the handle has a central gripper isolated along the handle a dampening spring, where the handle is adapted to rotate between a first and second position about an axis parallel to the longitudinal axis of the shaft.

Another embodiment of a post driver device includes a shaft having an axially extending interior cavity which extends to a closed top end of the shaft and to an open bottom end of the shaft. The closed top end forms a striking surface. A first mounting bracket extends from the exterior wall of the shaft. A handle is rotatably mounted to the mounting bracket, and the handle is adapted to rotate about an axis parallel to the longitudinal central axis of the shaft.

Figure 2:
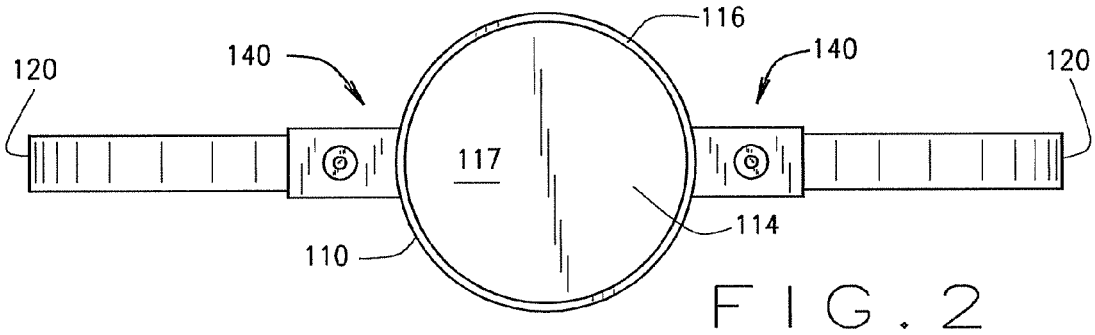
FIG. 2 is a bottom view of the post driving device shown in FIG. 1.

FIGS. 1 and 2A illustrate multiple views of a post driving device 100 according to a preferred embodiment of the present invention. As shown in FIG. 1, the post driving device 100 includes a cylindrical shaft 110 having a closed top end 112 forming a striking surface 117, and an axially extending interior cavity 114 extending to a distal open bottom end 116. The post driving device 100 of FIG. 1 further includes two handles 120, two upper dampening assemblies 130, two lower dampening assemblies 140, and a level 150.

Each handle 120 is physically connected to an upper dampening assembly 130 and a lower dampening assembly 140. Both upper dampening assemblies 130 are physically mounted to the cylindrical shaft 110 toward the top end 112 of the cylindrical shaft 110. Both lower dampening assemblies 140 are physically mounted to the cylindrical shaft 110 toward the bottom end 116 of the cylindrical shaft 110. The level 150 is physically mounted proximate the top end 112 of the cylindrical shaft 110. The axially extending interior cavity 114 is inside the cylindrical shaft 110 and extends to the open bottom end 116.

In operation, a post is held vertically on the spot where it is to be driven into the ground. The open bottom end 116 of the cylindrical shaft 110 is then placed over the top end of the post, and the post is allowed to slide up through the open bottom end 116 of the cylindrical shaft 110 into the axially extending interior cavity 114 of the cylindrical shaft 110 until the top of the post comes to rest against the closed top end 112 of the cylindrical shaft 110. The level 150 in the cylindrical shaft 110 then alerts the user if the post is currently perpendicular to the ground The user of the post driver device 100 grasps the handles 120, one in each hand, and lifts the post driver device 100. Once the post driver device 100 has been sufficiently lifted, the user quickly forces the post driver device 100 downward onto the post, such that the post again slides up through the open bottom end 116 of the cylindrical shaft 110 into the axially extending interior cavity 114 of the cylindrical shaft 110 until the closed top end 112 of the cylindrical shaft 110, which acts as a striking surface, forcefully impacts the top of the post, driving the post into the ground. This impact creates a great deal of vibration and shock in the cylindrical shaft 110 that is transferred to the handles 120. The upper damper assemblies 130 and the lower damper assemblies 140 dampen the vibration generated in the cylindrical shaft 110 before the shock and vibration reach the hands and body of the user. The previous post driver designs, which have the handles rigidly mounted to the cylindrical shaft, do not dampen the force transferred to the hands of the user, and the post drivers having the interior springs are not very effective because they only require the user to drive downward with a greater velocity and more force in order to drive a post.

Figure 3:
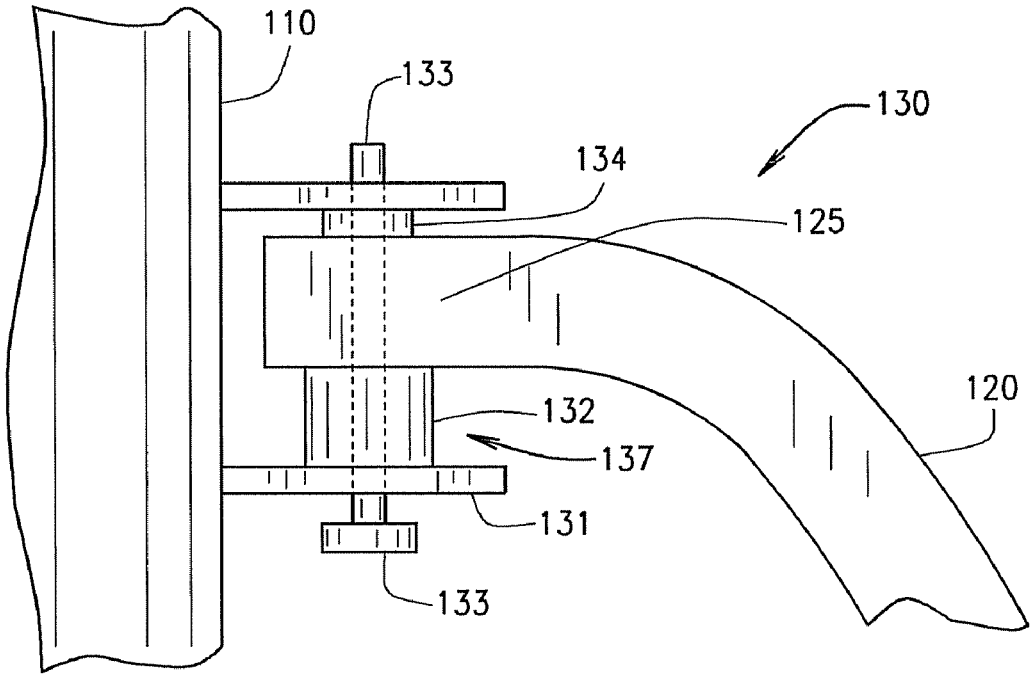
FIG. 3 is a magnified view of the top dampening assembly shown in FIG. 1.

The cylindrical shaft 110 may alternatively have a non-circular cross-section, such as a triangular, rectangular, or pentagonal cross-section, or any other shaped cross-section. The cylindrical shaft 110 may be made of a metal or metal alloy, or other material conducive to repeated impacts. The level 150 may alternatively be mounted anywhere on the post driving device 100, and more levels may be added to give information on more than just one axis. The closed top end 112 of the cylindrical shaft 110 may have some sort of a weight or durable substance with which to exert even more force on a post being driven into the ground. The post driver device 100 may be used to drive things other than posts in directions other than down into surfaces other than the ground. There may alternatively be more or less than two handles 120, and more or less than two upper damper assemblies 130 and two lower damper assemblies 140. Further, handles 120 may alternatively be mounted to more or less than two dampener assemblies 130, 140, though never less than one. FIG. 3 shows a magnified view of the upper damper assembly 130 according to an embodiment of the present invention. As shown in FIG. 3, the upper damper assembly 130 includes a first mounting bracket 131, a first damper 132, a first bolt 133, a first nut 134, a third mounting bracket 135, and a handle 120 having an upper mounting flange 125 at one end.

The first mounting bracket 131 and the third mounting bracket 135 are affixed to the cylindrical shaft 110. Between the two mounting brackets 131, 135 are, from bottom to top, the first damper 132, the upper mounting flange 125 of a handle 120, and the first nut 134. The first bolt 133 is inserted through an aperture of the first mounting bracket 131 up through an aperture in the first damper 132 and an aperture in the upper mounting flange 125 of a handle 120, and is secured in place by the first nut 134. A portion of the first bolt 133 extends through the first nut 134 and up through an aperture in the third mounting bracket 135. This creates a floating mount between the upper mounting flange 125 of the handle and the brackets 131, 135 attached to the cylindrical shaft 110.

In operation, the first bolt 133 and first nut 134 hold the components of the upper damper assembly 130 in place. The third mounting bracket 135 and first mounting bracket 131 connect the upper damper assembly 130 to the cylindrical shaft 110. The first bolt 133 connects the first damper 132 and the upper mounting flange 125 (and thus the handle 120) to the third mounting bracket 135 and the first mounting bracket 131, while the first nut 134 secures the first bolt 133 in place. The positioning of the components allows the upper mounting flange 125 (and thus the handle 120) to oscillate or float along the first bolt 133 and compress the first damper 132 when the closed top end 112 of the cylindrical shaft 110 is brought down and strikes an object. This dissipates much of the vibration and shock before it can travel from the cylindrical housing 110 to the handles 120. The first damper 132 then rebounds, pushing the upper mounting flange 125 (and thus the handle 120) back to its original position, completing one oscillation. In other words, the floating mount created by this assembly allows the upper mounting flange 125 of the handle 120 to oscillate or float up and down along a floating region 137 in which the damper 132 is installed.

In the alternative, things other than the first bolt 133 and first nut 134 may be used to hold the components of the upper assembly 130 in place in a floating relationship, such as adhesive, rivets, welding or other bonding techniques. The first damper 132 may take the form of dense foam or other elastomeric material or shock absorbing material, or may alternatively be a dampening spring or other mechanical shock absorbing device such as a pneumatic or hydraulic shock absorber. The order of the components in the upper damper assembly 130 may change, such as the position of the first nut 134 moving from under to over the third mounting bracket 135 or any similar change. The first damper 132 size and dampening ability may vary according to the needs of the user.

Figure 4:
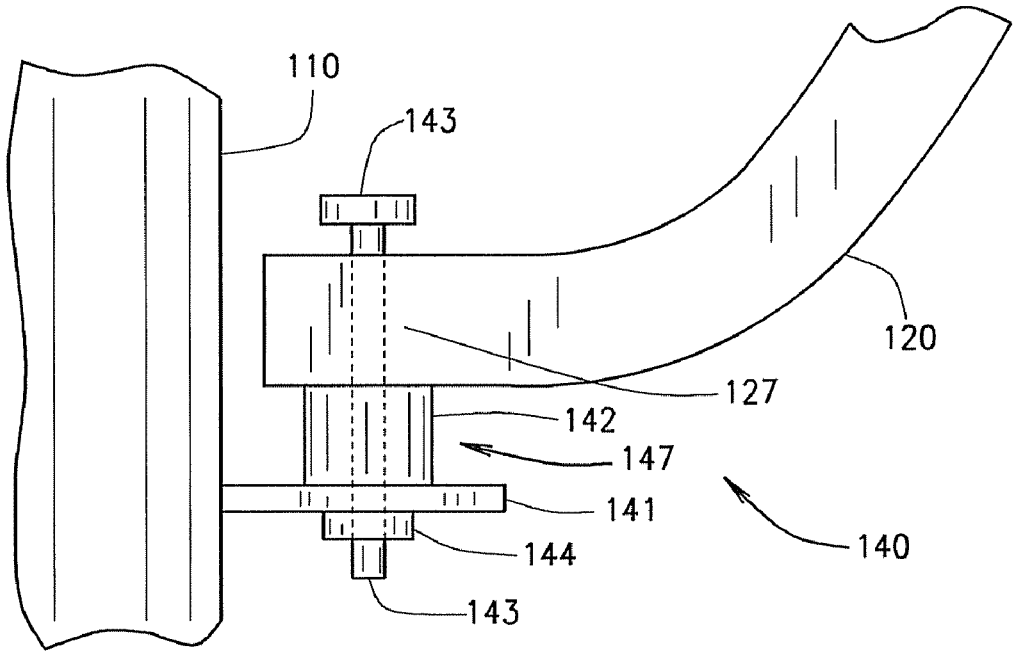
FIG. 4 is a magnified view of the bottom dampening assembly shown in FIG. 1.

FIG. 4 shows a magnified view of the lower damper assembly 140 according to an embodiment of the present invention. As shown in FIG. 4, the lower damper assembly 140 includes a second mounting bracket 141, a second damper 142, a second bolt 143, a second nut 144, and a handle 120 having a lower mounting flange 127 at one end.

The second mounting bracket 141 is connected to the cylindrical shaft 110. Above the second mounting bracket 141 is, from bottom to top, the second damper 142, and the lower mounting flange 127 of the handle 120. The second bolt 143 is inserted down through an aperture in the lower mounting flange 127, through an aperture in the second damper 142 and an aperture in the second mounting bracket 141, and is secured in place by the second nut 144 below the second mounting bracket 141 to a portion of the second bolt 143 extending through an aperture in the second mounting bracket 141. This creates a floating mount between the lower mounting flange 127 of the handle 120 and the second mounting bracket 141 attached to the cylindrical shaft 110.

In operation, the second bolt 143 and second nut 144 hold the components of the lower damper assembly 140 in place. The second mounting bracket 141 connects the lower damper assembly 140 to the cylindrical shaft 110. The second bolt 143 connects the second damper 142 and the lower mounting flange 127 of the handle 120 to the second bracket 141, while the second nut 144 secures the second bolt 143 in place. The positioning of the components allows the lower mounting flange 127 (and thus the handle 120) to oscillate or float along the second bolt 143 and compress the second damper 142 when the closed top end 112 of the cylindrical shaft 110 is brought down and strikes an object. This dampens much of the vibration and shock before it can travel from the cylindrical housing 110 to the handles 120. The second damper 142 then rebounds, pushing the lower mounting flange 127 (and thus the handle 120) back to its original position, completing one oscillation. In other words, the floating mount created by this assembly allows the lower mounting flange 127 of the handle 120 to oscillate or float up and down along a floating region 147 in which the damper 132 is installed.

In the alternative, things other than the second bolt 143 and second nut 144 may be used to hold the components of the lower assembly 140 in place, such as adhesive, rivets, welding or other bonding techniques. The second damper 142 may take the form of dense foam or elastomeric material or shock absorbing material, or may alternatively be a dampening spring or other mechanical shock absorbing device such as a hydraulic or pneumatic shock absorber. The order of the components in the lower damper 140 assembly may change, such as the orientation of the second bolt 144 being flipped 180 degrees such that it is inserted from the top down as opposed to from the bottom up, or any similar change.

Figure 5:
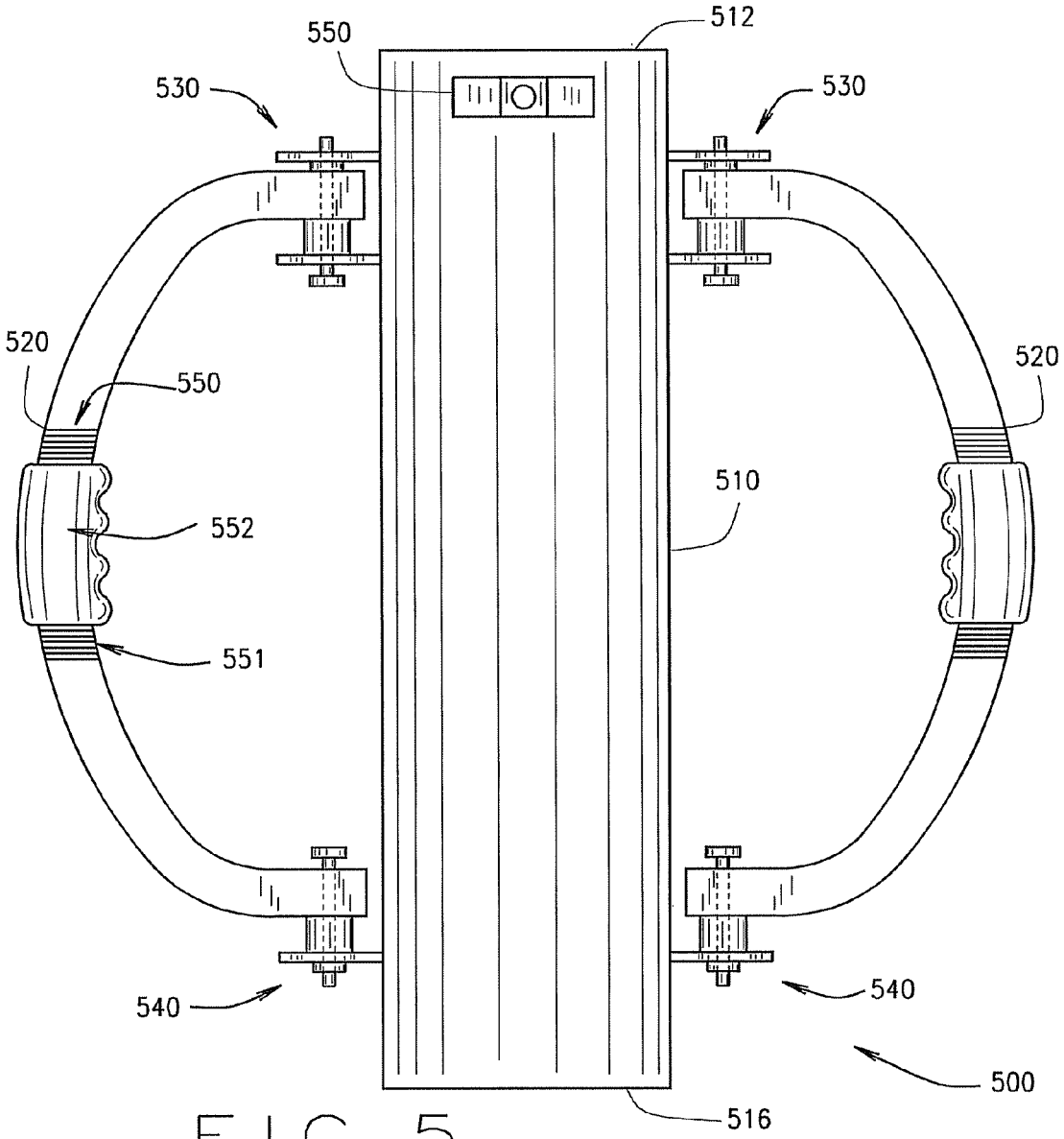
FIG. 5 is an elevation view of an alternative embodiment.
Figure 6:
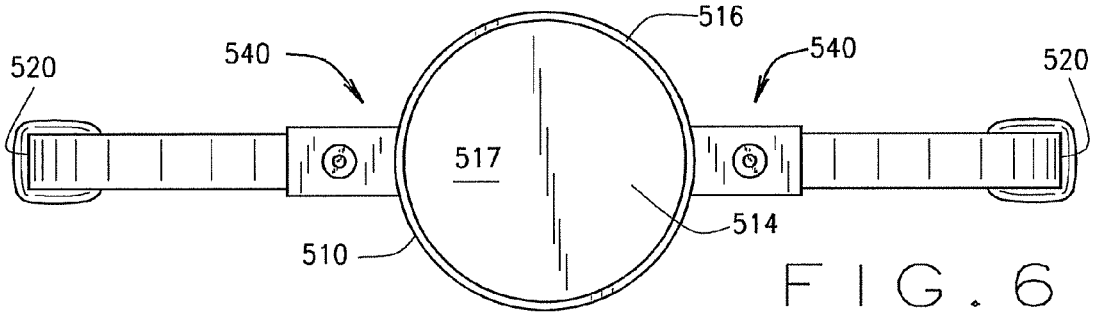
FIG. 6 is a bottom view thereof.

FIGS. 5 and 6 illustrate multiple views of a post driving device 500 according to a preferred embodiment of the present invention. As shown in FIG. 5, the post driving device 500 includes a cylindrical shaft 510 having a closed top end 512 forming a striking surface 517, and an axially extending interior cavity 514 extending to a distal open bottom end 516. The post driving device 500 of FIG. 5 further includes two handles 520, two upper dampening assemblies 530, two lower dampening assemblies 540, and a level 550.

Each handle 520 is physically connected to an upper dampening assembly 530 and a lower dampening assembly 540. Both upper dampening assemblies 530 are physically mounted to the cylindrical shaft 510 toward the top end 512 of the cylindrical shaft 510. Both lower dampening assemblies 540 are physically mounted to the cylindrical shaft 510 toward the bottom end 516 of the cylindrical shaft 510. The level 550 is physically mounted proximate the top end 512 of the cylindrical shaft 510. The axially extending interior cavity 514 is inside the cylindrical shaft 510 and extends to the open bottom end 516.

In operation, a post is held vertically on the spot where it is to be driven into the ground. The open bottom end 516 of the cylindrical shaft 510 is then placed over the top end of the post, and the post is allowed to slide up through the open bottom end 516 of the cylindrical shaft 510 into the axially extending interior cavity 514 of the cylindrical shaft 510 until the top of the post comes to rest against the closed top end 512 of the cylindrical shaft 510. The level 550 in the cylindrical shaft 510 then alerts the user if the post is currently perpendicular to the ground.

The user of the post driver device 500 grasps the handles 520, one in each hand, and lifts the post driver device 500. Once the post driver device 500 has been sufficiently lifted, the user quickly forces the post driver device 500 downward onto the post, such that the post again slides up through the open bottom end 516 of the cylindrical shaft 510 into the axially extending interior cavity 514 of the cylindrical shaft 510 until the closed top end 512 of the cylindrical shaft 510, which acts as a striking surface, forcefully impacts the top of the post, driving the post into the ground. This impact creates a great deal of vibration and shock in the cylindrical shaft 510 that is transferred to the handles 520. The upper damper assemblies 530 and the lower damper assemblies 540 dampen the vibration generated in the cylindrical shaft 510 before the shock and vibration reach the hands and body of the user. The previous post driver designs, which have the handles rigidly mounted to the cylindrical shaft, does not dampen the force transferred to the hands of the user, and the post drivers having the interior springs are not very effective because they only require the user to drive downward with a greater velocity and more force in order to drive a post.

The cylindrical shaft 510 may alternatively have a non-circular cross-section, such as a triangular, rectangular, or pentagonal cross-section, or any other shaped cross-section. The cylindrical shaft 510 may be made of a metal or metal alloy, or other material conducive to repeated impacts. The level 550 may alternatively be mounted anywhere on the post driving device 500, and more levels may be added to give information on more than just one axis. The closed top end 512 of the cylindrical shaft 510 may have some sort of a weight or durable substance with which to exert even more force on a post being driven into the ground. The post driver device 500 may be used to drive things other than posts in directions other than down into surfaces other than the ground. There may alternatively be more or less than two handles 520, and more or less than two upper damper assemblies 530 and two lower damper assemblies 540. Further, handles 520 may alternatively be mounted to more or less than two dampener assemblies 530, 540, though never less than one. The handle can include a dampening device system 550 and 551 and gripper handle 552 in addition to the damper assembly 130 described above or in lieu of damper assembly 130.

Figure 7A:
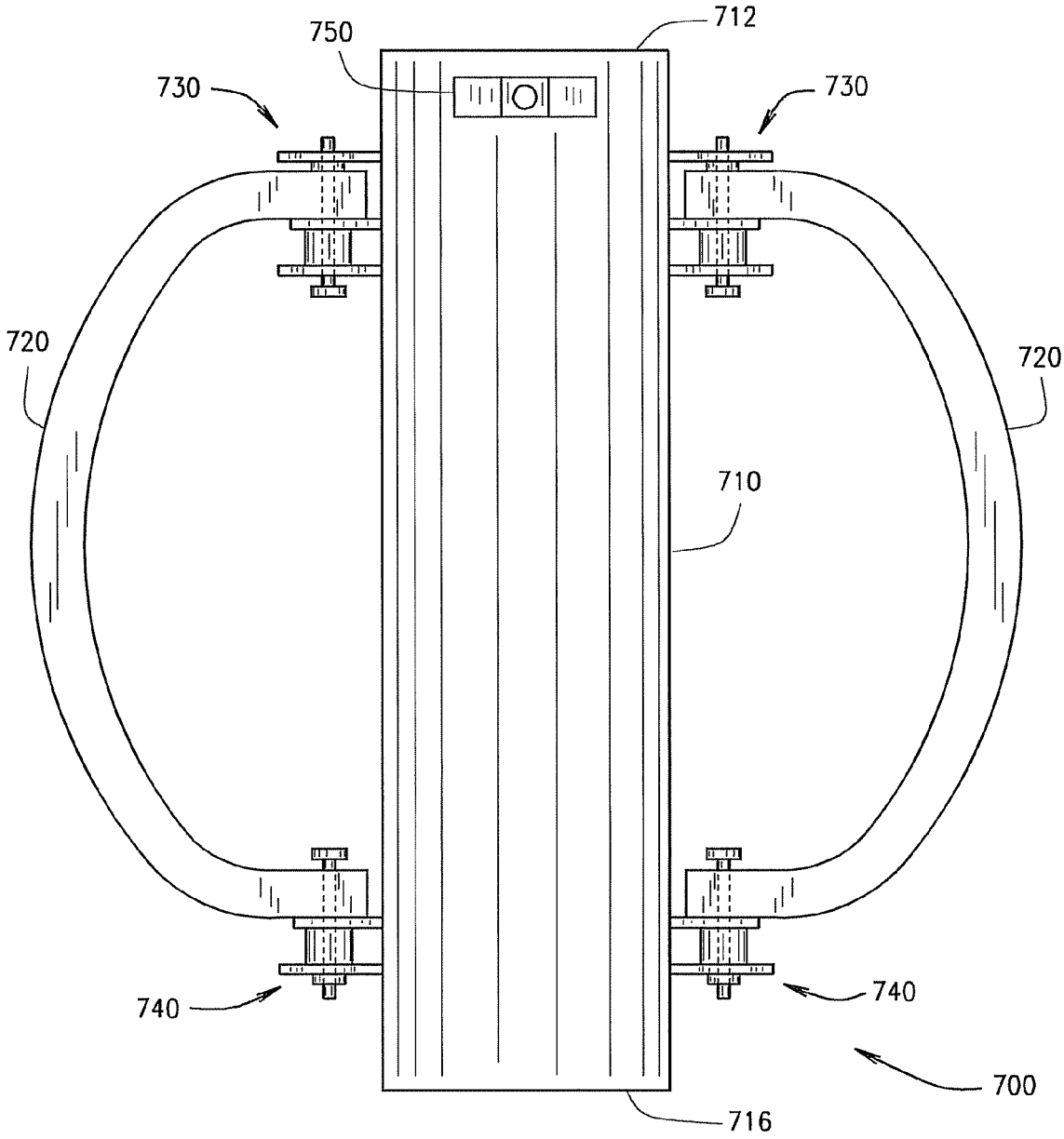
FIG. 7A is an elevation view of another embodiment of the post driving device.
Figure 7B:
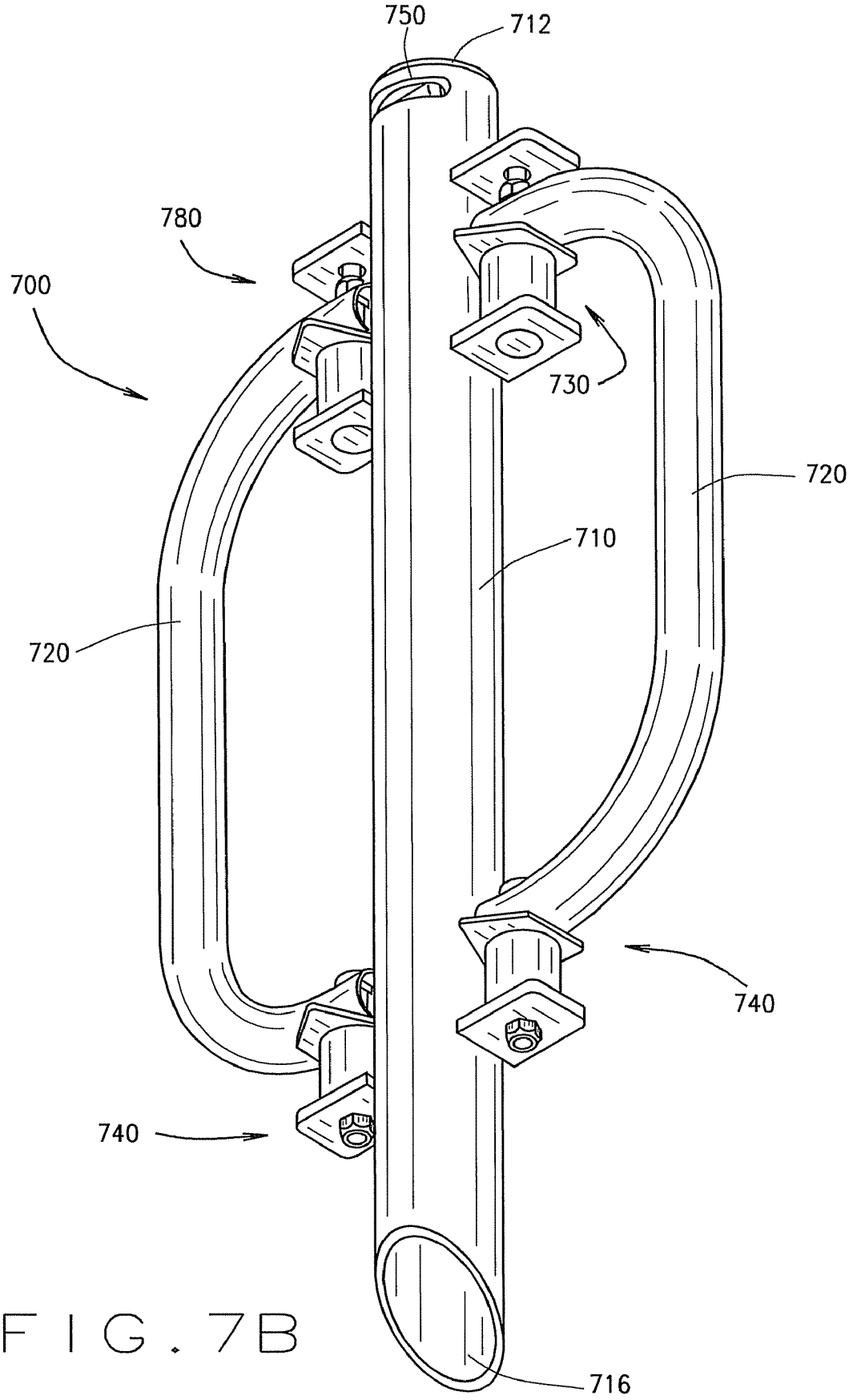
FIG. 7B is a perspective view of the post driving device shown in FIG. 7A.
Figure 8:
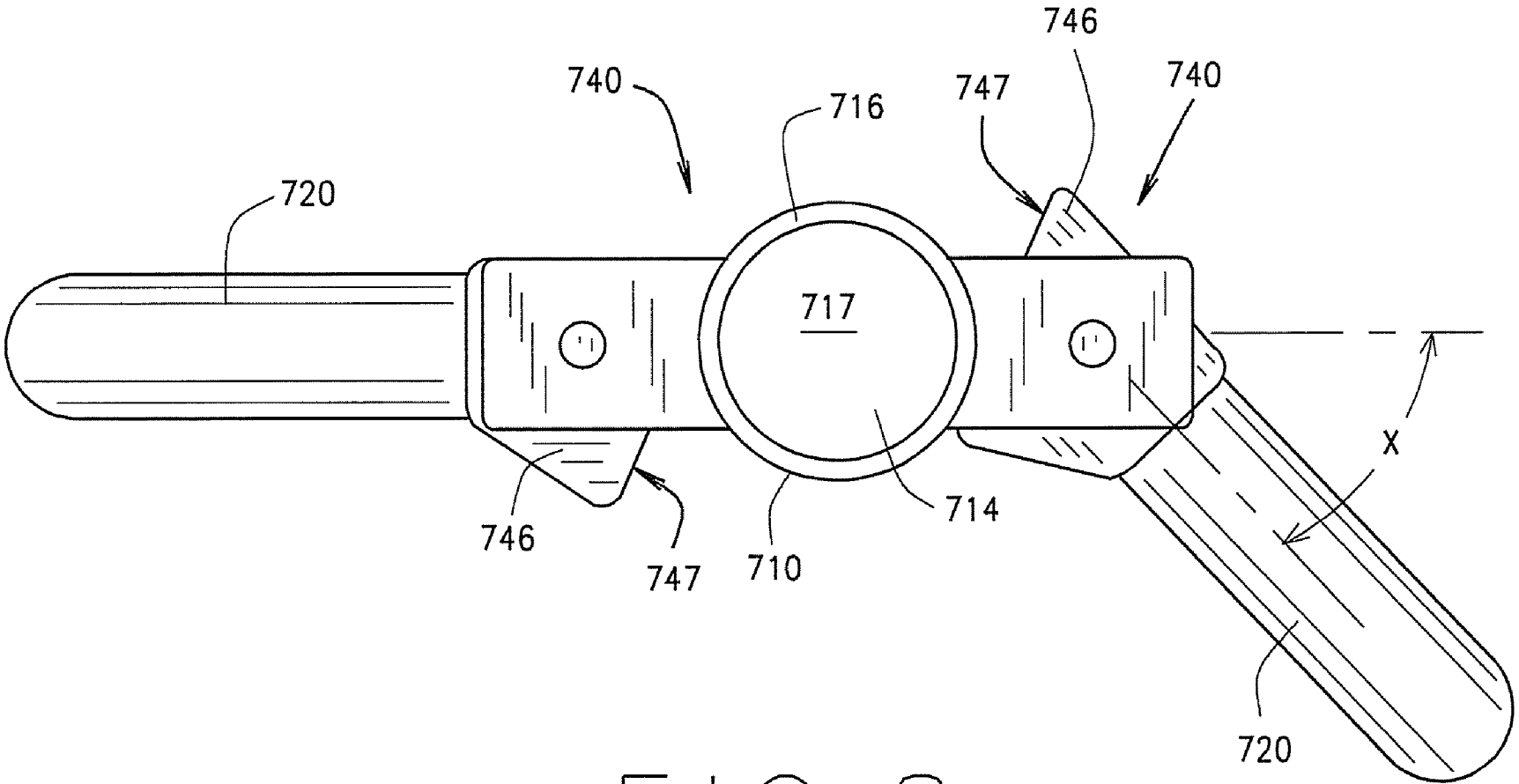
FIG. 8 is a bottom view of the post driving device shown in FIG. 7A.
Figure 9:
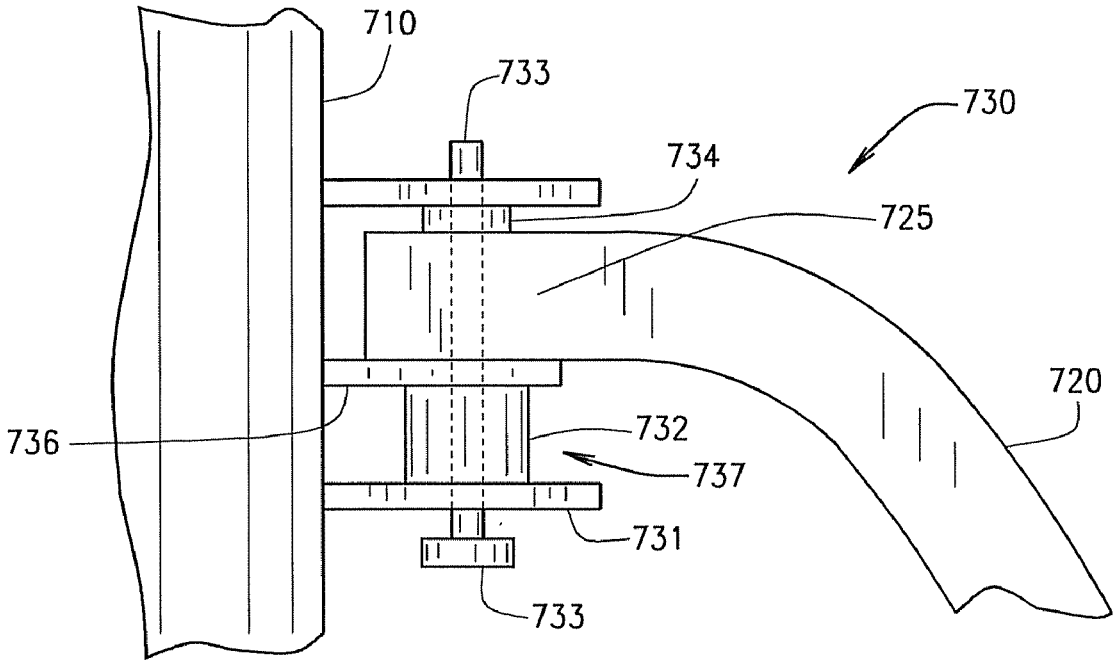
FIG. 9 is a magnified view of the top dampening assembly shown in FIG. 7A.

FIGS. 7A, 7B and 8 illustrate multiple views of a post driving device 700 according to another embodiment of the present invention. As shown in FIGS. 7A and 7B, the post driving device 700 includes a cylindrical shaft 710 having a closed top end 712 forming a striking surface 717, and an axially extending interior cavity 714 extending to a distal open bottom end 716. The post driving device 700 of FIGS. 7A and 7B further includes two handles 720, two upper dampening assemblies 730, two lower dampening assemblies 740, and a level 750. Each upper dampening assembly 730 includes an upper rotation flange 736, and each lower dampening assembly 740 includes a lower rotation flange 746. Each lower rotation flange 746 has a leading edge 747, which leading edge 747 has a first end 748 and a second end 749, each of which are shown in FIG. 8. Each upper rotation flange 736 has a leading edge 737, which leading edge 737 has a first end 738 and a second end 739. Leading edge 737 is shown in FIG. 9, but the first and second ends 738, 739 are not shown.

Each handle 720 is physically connected to an upper dampening assembly 730 and a lower dampening assembly 740. Both upper dampening assemblies 730 are physically mounted to the cylindrical shaft 710 toward the top end 712 of the cylindrical shaft 710. Both lower dampening assemblies 740 are physically mounted to the cylindrical shaft 710 toward the bottom end 716 of the cylindrical shaft 710. The level 750 is physically mounted proximate the top end 712 of the cylindrical shaft 710. The axially extending interior cavity 714 is inside the cylindrical shaft 710 and extends to the open bottom end 716. In the embodiment shown in FIGS. 7-10, the rotation flanges 736, 746 have leading edges 737, 747 with first ends 738, 748 and second ends 739, 749. When a handles 720 (and thus the rotation flanges 736, 746) are rotated to the first position, the first ends 738, 748 of the leading edges 737, 747 of the rotation flanges 736, 746 abut the shaft 710 of the post driver 700, preventing further rotation of the handle 720 in that direction. Similarly, when the handle 720 is rotated in the opposite direction to the second position, the second ends 739, 749 of the leading edges 737, 747 of the rotation flanges 736, 746 abut the shaft 710 of the post driver 700, preventing further rotation of the handle 720 in that direction.

Rotation flanges 736, 746 are illustrated in FIG. 8 as having an irregular quadrilateral shape which allows a handle to rotate X degrees about an axis parallel to the longitudinal axis of the post driver 700 from a position perpendicular to the longitudinal central axis of the post driver 700 to a position offset by X degrees from the perpendicular position. It is understood that the shape of the rotation flanges 736 and 746 determine the value of X. As illustrated in FIG. 8, X equals approximately 45 degrees.

The user of the post driver device 700 grasps the handles 720, one in each hand, and positions either or both handles 720: (1) at a first position perpendicular to the longitudinal central axis of the shaft 710; (2) at a second position which is X degrees offset from the perpendicular position; or (3) in a third position anywhere therebetween. In one embodiment, either or both handles may be releasably secured in a position to keep the handle or handles from rotating during the driving of a post, though either or both handles may be left free to rotate. Once the post driver device 700 has been sufficiently lifted, the user quickly forces the post driver device 700 downward onto the post, such that the post again slides up through the open bottom end 716 of the cylindrical shaft 710 into the axially extending interior cavity 714 of the cylindrical shaft 710 until the closed top end 712 of the cylindrical shaft 710, which acts as a striking surface, forcefully impacts the top of the post, driving the post into the ground. This impact creates a great deal of vibration and shock in the cylindrical shaft 710 that is transferred to the handles 720. The upper damper assemblies 730 and the lower damper assemblies 740 dampen the vibration generated in the cylindrical shaft 710 before the shock and vibration reach the hands and body of the user. The previous post driver designs, which have the handles rigidly mounted to the cylindrical shaft, do not dampen the force transferred to the hands of the user, and the post drivers having the interior springs are not very effective because they only require the user to drive downward with a greater velocity and more force in order to drive a post.

The cylindrical shaft 710 may alternatively have a non-circular cross-section, such as a triangular, rectangular, or pentagonal cross-section, or any other shaped cross-section. The cylindrical shaft 710 may be made of a metal or metal alloy, or other material conducive to repeated impacts. The level 750 may alternatively be mounted anywhere on the post driving device 700, and more levels may be added to give information on more than just one axis. The closed top end 712 of the cylindrical shaft 710 may have some sort of a weight or durable substance with which to exert even more force on a post being driven into the ground. The post driver device 700 may be used to drive things other than posts in directions other than down into surfaces other than the ground. There may alternatively be more or less than two handles 720, and more or less than two upper damper assemblies 730 and two lower damper assemblies 740. Further, handles 720 may alternatively be mounted to more or less than two dampener assemblies 730, 740, though never less than one. It is noted that the shape of the rotation flanges 736, 746 illustrated in FIG. 8 is exemplary, and that the rotation flanges 736, 746 may have a different shape which allows for a different value of X. Additionally, the mechanism which allows for the rotation of the handles between two points need not be a rotation flange 736, 746 at all, but may be of any design known in the art which would achieve the goal of allowing the handles to rotate, between at least two positions as may be needed.

FIG. 9 shows a magnified view of the upper damper assembly 730 according to an embodiment of the present invention. As shown in FIG. 9, the upper damper assembly 730 includes a first mounting bracket 731, a first damper 732, a first bolt 733, a first nut 734, a third mounting bracket 735, and a handle 720 having an upper mounting flange 725 at one end. The upper mounting flange 725 includes an upper rotation flange 736 having a leading edge 737.

The first mounting bracket 731 and the third mounting bracket 735 are affixed to the cylindrical shaft 710. Between the two mounting brackets 731, 735 are, from bottom to top, the first damper 732, the upper rotation flange 736 and the upper mounting flange 725 of a handle 720, and the first nut 734. The first bolt 733 is inserted through an aperture of the first mounting bracket 731 up through an aperture in the first damper 732 and apertures in the upper rotation flange 736 and upper mounting flange 725 of a handle 720, and is secured in place by the first nut 734. A portion of the first bolt 733 extends through the first nut 734 and up through an aperture in the third mounting bracket 735. This creates a floating mount between the upper mounting flange 725 of the handle and the brackets 731, 735 attached to the cylindrical shaft 710, which also allows the handle 720 to rotate between a first and second position about the longitudinal axis of the first bolt 133 as allowed by the upper rotation flange 737.

In operation, the first bolt 733 and first nut 734 hold the components of the upper damper assembly 730 in place. The third mounting bracket 735 and first mounting bracket 731 connect the upper damper assembly 730 to the cylindrical shaft 710. The first bolt 733 connects the first damper 732 and the upper mounting flange 725 (and thus the handle 720) to the third mounting bracket 735 and the first mounting bracket 731, while the first nut 734 secures the first bolt 733 in place. The positioning of the components allows the upper mounting flange 725 (and thus the handle 720) to oscillate or float along the first bolt 733 and compress the first damper 732 when the closed top end 712 of the cylindrical shaft 710 is brought down and strikes an object. This dissipates much of the vibration and shock before it can travel from the cylindrical housing 710 to the handles 720. The first damper 732 then rebounds, pushing the upper mounting flange 725 (and thus the handle 720) back to its original position, completing one oscillation. In other words, the floating mount created by this assembly allows the upper mounting flange 725 of the handle 720 to oscillate or float up and down along a floating region 737 in which the damper 732 is installed. The floating mount also allows a handle 720 to rotate between a first position and second position around the longitudinal axis of bolt 733 as allowed by the upper rotation flange 736.

In the alternative, things other than the first bolt 733 and first nut 734 may be used to hold the components of the upper assembly 730 in place in a floating relationship, such as adhesive, rivets, welding or other bonding techniques. The first damper 732 may take the form of dense foam or other elastomeric material or shock absorbing material, or may alternatively be a dampening spring or other mechanical shock absorbing device such as a pneumatic or hydraulic shock absorber. The order of the components in the upper damper assembly 730 may change, such as the position of the first nut 734 moving from under to over the third mounting bracket 135 or any similar change. The first damper 732 size and dampening ability may vary according to the needs of the user. Additionally, a floating mount need not have a damper 732 or any significant dampening ability to allow handle to rotate about the longitudinal axis of the bolt.

Figure 10:
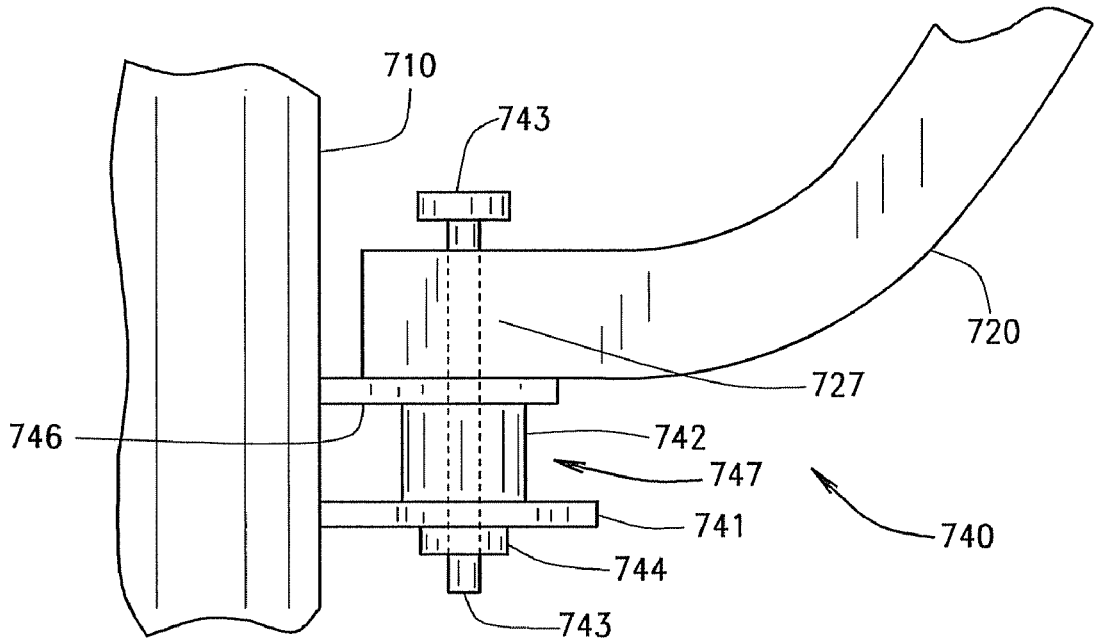
FIG. 10 is a magnified view of the bottom dampening assembly shown in FIG. 7A.

FIG. 10 shows a magnified view of the lower damper assembly 740 according to an embodiment of the present invention. As shown in FIG. 10, the lower damper assembly 740 includes a second mounting bracket 741, a second damper 742, a second bolt 743, a second nut 744, and a handle 720 having a lower mounting flange 727 at one end. The lower mounting flange 727 includes an lower rotation flange 746 having a leading edge 747.

The second mounting bracket 741 is connected to the cylindrical shaft 710. Above the second mounting bracket 741 is, from bottom to top, the second damper 742, the lower rotation flange 746 and the lower mounting flange 727 of the handle 720. The second bolt 743 is inserted down through apertures in the lower rotation flange 746 and in the lower mounting flange 727, through an aperture in the second damper 742 and an aperture in the second mounting bracket 741, and is secured in place by the second nut 744 below the second mounting bracket 741 to a portion of the second bolt 743 extending through an aperture in the second mounting bracket 741. This creates a floating mount between the lower mounting flange 727 of the handle 720 and the second mounting bracket 741 attached to the cylindrical shaft 710, which also allows the handle 720 to rotate about the longitudinal axis of the second bolt 743 as allowed by the lower rotation flange 746.

In operation, the second bolt 743 and second nut 744 hold the components of the lower damper assembly 740 in place. The second mounting bracket 741 connects the lower damper assembly 740 to the cylindrical shaft 710. The second bolt 743 connects the second damper 742 and the lower mounting flange 727 of the handle 720 to the second bracket 741, while the second nut 744 secures the second bolt 743 in place. The positioning of the components allows the lower mounting flange 727 (and thus the handle 720) to oscillate or float along the second bolt 743 and compress the second damper 742 when the closed top end 712 of the cylindrical shaft 710 is brought down and strikes an object. This dampens much of the vibration and shock before it can travel from the cylindrical housing 710 to the handles 720. The second damper 742 then rebounds, pushing the lower mounting flange 727 (and thus the handle 720) back to its original position, completing one oscillation. In other words, the floating mount created by this assembly allows the lower mounting flange 727 of the handle 720 to oscillate or float up and down along a floating region 747 in which the damper 732 is installed. The floating mount also allows a handle 720 to rotate between a first and second position around the longitudinal axis of bolt 743 as allowed by the lower rotation flange 746.

In the alternative, things other than the second bolt 743 and second nut 744 may be used to hold the components of the lower assembly 740 in place, such as adhesive, rivets, welding or other bonding techniques. The second damper 742 may tale the form of dense foam or elastomeric material or shock absorbing material, or may alternatively be a dampening spring or other mechanical shock absorbing device such as a hydraulic or pneumatic shock absorber. The order of the components in the lower damper 740 assembly may change, such as the orientation of the second bolt 744 being flipped 780 degrees such that it is inserted from the top down as opposed to from the bottom up, or any similar change.

One or more embodiments of the present invention dissipate the vibration and shock that are created by driving posts into the ground more readily than current post drivers through the use of more and bigger and better dampers mounted directly between the handles and cylindrical shaft of the device. This increased shock absorption decreases the strain on the user of the device, which lessens the likelihood of injury and allows users to use the device for longer periods of time.

While particular elements, embodiments, and applications of the present invention have been shown and described, it is understood that the invention is not limited thereto because modifications may be made by those skilled in the art, particularly in light of the foregoing teachings. It is therefore contemplated by the appended claims to cover such modifications and incorporate those features which come within the spirit and scope of the invention.

I claim:

1. A post driving device including:

a shaft having an axially extending interior cavity, said cavity extending to a closed top end of said shaft and to a distal open bottom end of said shaft, said closed top end forming a striking surface, and said shaft having a first mounting bracket extending from an exterior wall of said shaft;

a handle having an upper mounting flange mounted to said first mounting bracket by a first floating mount having a first floating region, where said first floating mount is adapted to allow said handle to rotate between at least a first and second position about an axis parallel to the longitudinal axis of the shaft and wherein said first floating mount including a rotation flange physically connected to said upper mounting flange such that said rotation flange rotates in combination with said handle, where said rotation flange includes a leading edge portion having a first end portion and a second end portion such that an end portion abuts said shaft when said handle is rotated to one of said first and second positions, thereby preventing further rotation of said handle past said one of said first and second positions; and a first dampening spring positioned between said upper mounting flange of said handle and said first mounting bracket, where said first dampening spring extends into said first floating region, and where said first dampening spring dampens vibration between said shaft and said handle.

2. A post driving device including:

a shaft having an axially extending interior cavity, said cavity extending to a closed top end of said shaft and to a distal open bottom end of said shaft, said closed top end forming a striking surface, and said shaft having a first mounting bracket extending from an exterior wall of said shaft;

a handle having an upper mounting flange mounted to said first mounting bracket by a first floating mount having a first floating region, where said first floating mount is adapted to allow said handle to rotate between at least a first and second position about an axis parallel to a longitudinal axis of the shaft;

a first dampening spring positioned between said upper mounting flange of said handle and said first mounting bracket, where said first dampening spring extends into said first floating region, and where said first dampening spring dampens vibration between said shaft and said handle;

a second dampening spring positioned between a lower mounting flange of said handle and a second mounting bracket extending from said exterior wall of said shaft, where said lower mounting flange is mounted to said second mounting bracket by a second floating mount having a second floating region, where said second floating mount is adapted to allow said handle to rotate between said first and second positions about said axis parallel to the longitudinal axis of the shaft, and where said second dampening spring extends into said floating region, and where said second dampening spring dampens vibration between said shaft and said handle wherein said first floating mount and said second floating mount each including a rotation flange physically connected to a said respective mounting flange such that said rotation flanges rotate in combination with said handle, where each said rotation flange includes a leading edge portion having a first end portion and a second end portion such that at least one an end portion abuts said shaft when said handle is rotated to one of said first and second positions, thereby preventing further rotation of said handle past said one of said first and second positions.

3. The post driving device of claim 2, wherein said upper mounting flange is floatingly attached to said first mounting bracket with a first nut and first bolt, where said first bolt is inserted vertically up through an aperture in said first mounting bracket, an aperture in said first dampening spring, an aperture in an upper rotation flange, an aperture in said upper mounting flange, an aperture in said first nut, and an aperture in a third mounting bracket of said shaft extending from said exterior wall of said shaft, where said first nut secures said first bolt in place; and said lower mounting flange is floatingly attached to said second mounting bracket with a second nut and second bolt, where said second bolt is inserted vertically down through an aperture in said lower mounting flange of said handle, an aperture in a lower rotation flange, an aperture in said second dampening spring, an aperture in said second mounting bracket, and an aperture in said second nut, where said second nut secures said second bolt in place.

4. The post driving device of claim 3, wherein said handle rotates about the longitudinal axis of said first and second bolt.

5. The post driving device of claim 3, wherein said rotation flanges are adapted to allow said handle to rotate between a first position perpendicular to the longitudinal central axis of the shaft and a second position which is offset from said first position by at least 10 degrees.

6. The post driving device of claim 5, wherein said second position is offset from said first position by 45 degrees.

7. A post driving device including:

a shaft having an axially extending interior cavity, said cavity extending to a closed top end of said shaft and to a distal open bottom end of said shaft, said closed top end forming a striking surface, and said shaft having a first mounting bracket extending from an exterior wall of said shaft;

a handle having an upper mounting flange mounted to said first mounting bracket by a first floating mount having a first floating region, where said first floating mount is adapted to allow said handle to rotate between at least a first and second position about an axis parallel to a longitudinal axis of the shaft, and wherein said floating mount allows said handle to rotate to a third position between said first and second positions;

a first dampening spring positioned between said upper mounting flange of said handle and said first mounting bracket, where said first dampening spring extends into said first floating region, and where said first dampening spring dampens vibration between said shaft and said handle and wherein said first floating mount and said second floating mount each including a rotation flange physically connected to a said respective mounting flange such that said rotation flanges rotate in combination with said handle, where each said rotation flange includes a leading edge portion having a first end portion and a second end portion such that at least one an end portion abuts said shaft when said handle is rotated to one of said first and second positions, thereby preventing further rotation of said handle past said one of said first and second positions.

8. The post driving device of claim 7, wherein said handle being releasably securable against further rotation in a said position.

9. A post driving device including:

a handle mounted to a shaft by a first floating mount having a first floating region, where said first floating mount allows said handle to oscillate within said first floating region, and where said first floating mount is adapted to allow said handle to rotate between a first and second position about an axis parallel to a longitudinal axis of the shaft, wherein said handle is additionally mounted to said shaft by a second floating mount having a second floating region, where said second floating mount allows said handle to oscillate within said second floating region and said second floating mount is also adapted to allow said handle to rotate about said axis parallel to the longitudinal axis of the shaft, and a second dampening spring positioned between said handle and said shaft, where said second dampening spring extends into said second floating region of said second floating mount where said second dampening spring dampens vibration between said shaft and said handle, wherein said first floating mount and said second floating mount each including a rotation flange physically connected to a said respective mounting flange such that said rotation flanges rotate in combination with said handle, where each said rotation flange includes a leading edge portion having a first end portion and a second end portion such that at least one an end portion abuts said shaft when said handle is rotated to one of said first and second positions, thereby preventing further rotation of said handle past said one of said first and second positions; and a first dampening spring positioned between said handle and said shaft, where said first dampening spring extends into said first floating region, and where said first dampening spring dampens vibration between said shaft and said handle.

10. A post driving device including:

a handle mounted to a shaft by a first floating mount having a first floating region, where said first floating mount allows said handle to oscillate within said first floating region, and where said first floating mount is adapted to allow said handle to rotate between a first and second position about an axis parallel to the longitudinal axis of the shaft, wherein said handle is additionally mounted to said shaft by a second floating mount having a second floating region, where said second floating mount allows said handle to oscillate within said second floating region and said second floating mount is also adapted to allow said handle to rotate about said axis parallel to a longitudinal axis of the shaft, and a second dampening spring positioned between said handle and said shaft, where said second dampening spring extends into said second floating region of said second floating mount where said second dampening spring dampens vibration between said shaft and said handle;

a first dampening spring positioned between said handle and said shaft, where said first dampening spring extends into said first floating region, and where said first dampening spring dampens vibration between said shaft and said handle, wherein said first floating mount includes a first mounting bracket extending from an exterior wall of said shaft, a third mounting bracket extending from said exterior wall of said shaft, a first nut and first bolt, where said first bolt is inserted vertically up through an aperture in said first mounting bracket, an aperture in said first dampening spring, an aperture in an upper rotation flange, an aperture in an upper mounting flange of said handle, an aperture in said first nut, and an aperture in said third mounting bracket, where said first nut secures said first bolt in place, and said second floating mount includes a second mounting bracket extending from said exterior wall of said shaft, a second nut and second bolt, where said second bolt is inserted vertically down through an aperture in a lower mounting flange of said handle, an aperture in a lower rotation flange, an aperture in said second dampening spring, an aperture in said second mounting bracket, and an aperture in said second nut, where said second nut secures said second bolt in place wherein said first floating mount and said second floating mount each including a rotation flange physically connected to a said respective mounting flange such that said rotation flanges rotate in combination with said handle, where each said rotation flange includes a leading edge portion having a first end portion and a second end portion such that at least one an end portion abuts said shaft when said handle is rotated to one of said first and second positions, thereby preventing further rotation of said handle past said one of said first and second positions.

11. The post driving device of claim 10, wherein said handle rotates about the longitudinal axis of said first and second bolt.

12. The post driving device of claim 10, wherein said at least one rotation flanges are adapted to allow said handle to rotate between a first position perpendicular to the longitudinal central axis of the shaft and a second position which is offset from said first position by at least 10 degrees.

13. The post driving device of claim 12, wherein said second position is offset from said first position by 45 degrees.

14. A post driving device including:

a handle mounted to a shaft by a first floating mount having a first floating region, where said first floating mount allows said handle to oscillate within said first floating region, and where said first floating mount is adapted to allow said handle to rotate between a first and second position about an axis parallel to a longitudinal axis of the shaft; and a first dampening spring positioned between said handle and said shaft, where said first dampening spring extends into said first floating region, and where said first dampening spring dampens vibration between said shaft and said handle, wherein said floating mount allows said handle to rotate to a third position between said first and second positions wherein said handle us additionally mounted to said shaft by a floating mount having a second floating region, where said second mount allows said handle to oscillate within said second floating region and said second floating mount is also adapted to allow said handle to rotate about said axis parallel to a longitudinal axis of the shaft, and a second damping spring positioned between said handle and said shaft, where said second damping spring extends into said floating region of said second floating mount where said second damping spring vibrates between said shaft and said handle; and wherein said first floating mount and said second floating mount each including a rotation flange physically connected to a said respective mounting flange such that said rotation flanges rotate in combination with said handle, where each said rotation flange includes a leading edge portion having a first end portion and a second end portion such that at least one an end portion abuts said shaft when said handle is rotated to one of said first and second positions, thereby preventing further rotation of said handle past said one of said first and second positions.

15. The post driving device of claim 14, wherein said handle being releasably securable against further rotation in a said position.

16. A vibration dampening method including:

dampening vibration between a shaft and a handle, wherein said handle is floatingly attached to said shaft by a first floating mount, where said first floating mount is adapted to allow said handle to rotate between a first and second position about an axis parallel to a longitudinal axis of the shaft, and wherein said dampening occurs in a first dampening spring positioned in a first floating region of said first floating mount between said handle and said shaft, wherein said dampening additionally occurs in a second dampening spring positioned in a second floating region of a second floating mount between said handle and said shaft, where said second floating mount is additionally adapted to allow said handle to rotate about an axis parallel to the longitudinal central axis of the shaft, and wherein said first floating mount and said second floating mount each including a rotation flange physically connected to a said respective mounting flange such that said rotation flanges rotate in combination with said handle, where each said rotation flange includes a leading edge portion having a first end portion and a second end portion such that at least one an end portion abuts said shaft when said handle is rotated to one of said first and second positions, thereby preventing further rotation of said handle past said one of said first and second positions.

* * * * *